US005271259A

United States Patent [19]

Miller et al.

[11] Patent Number: 5,271,259

[45] Date of Patent: Dec. 21, 1993

[54] ELECTROMAGNETIC REDRAW ACTUATOR

[75] Inventors: Edward C. Miller, Broomfield; Randall S. Worwag, Arvada, both of Colo.

[73] Assignee: Ball Corporation, Muncie, Ind.

[21] Appl. No.: 897,863

[22] Filed: Jun. 12, 1992

[51] Int. Cl.[5] ..... B21D 22/28

[52] U.S. Cl. ..... 72/349; 72/350

[58] Field of Search ..... 72/347, 349, 350, 351, 72/430, 456; 310/13, 15

[56] References Cited

U.S. PATENT DOCUMENTS

| | | | |
|---|---|---|---|
| 1,606,141 | 11/1926 | Brown . | |
| 3,986,382 | 10/1976 | Miller et al. | 72/349 |
| 4,614,104 | 9/1986 | Straw | 72/347 |
| 4,807,459 | 2/1989 | Grims et al. | 72/347 |
| 4,808,955 | 2/1989 | Godkin et al. | 310/13 |
| 4,827,163 | 5/1989 | Bhate et al. | 310/15 |
| 4,855,702 | 8/1989 | Swanson et al. | 335/261 |
| 4,912,343 | 3/1990 | Stuart | 310/14 |
| 4,972,108 | 11/1990 | Venturini | 310/12 |
| 5,013,945 | 5/1991 | Adolfsson | 310/26 |
| 5,079,459 | 1/1992 | Huston et al. | 310/15 |
| 5,129,252 | 7/1992 | Hahn et al. | 72/349 |
| 5,138,862 | 8/1992 | Chasteen et al. | 72/456 |

FOREIGN PATENT DOCUMENTS

WO92/04142 3/1992 PCT Int'l Appl. .

*Primary Examiner*—Lowell A. Larson

*Attorney, Agent, or Firm*—Gilbert E. Alberding

[57] ABSTRACT

An apparatus is provided for extending and retracting a redraw sleeve of a container bodymaker and for electromagnetically holding the redraw sleeve in its extended position against a container blank. A linear motor is disposed between two bulkheads and is interconnected with the redraw sleeve through one or more actuating rods. An electromagnet assembly is disposed proximate to a redraw die and, when activated, holds the redraw sleeve against the container blank while a reciprocating ram forces the container blank through the redraw die. The linear motor and the electromagnet assembly are axially disposed relative to the redraw die and the bulkheads to provide adequate access to the nose of the ram, the redraw sleeve and other components.

6 Claims, 3 Drawing Sheets

ELECTROMAGNETIC REDRAW ACTUATOR

TECHNICAL FIELD OF THE INVENTION

This invention relates to bodymakers for forming drawn and ironed metal containers and, in particular, to a bodymaker having an apparatus for providing reciprocal linear motion to a redraw sleeve and for holding the redraw sleeve in an extended position against a container blank and opposing face of a redraw die while a reciprocating ram forces the container blank through the redraw die.

BACKGROUND OF THE INVENTION

Modern two-piece containers, such as aluminum beverage containers, having an integrated sidewall/bottom and a separate top are formed, in part, by large ram/die bodymakers. Briefly, the bodymaker receives a shallow, cup-like container blank having a larger diameter and thickness than the container body to be formed, and a reciprocating ram forces the blank through a series of drawing and ironing dies within a tool pack to reduce the diameter of the blank and thin and lengthen the sidewall. As a final step, the ram forces the just-formed container body against a domer to produce the bottom dome geometry of the container. The ram retracts and the container body is removed from the bodymaker and transported to other apparatus for necking, coating and other finishing operations.

The first die in the tool pack is a redraw die which, through a method of cold working, substantially reduces the diameter of the container blank, lengthens the sidewall and begins the sidewall thinning process. After the blank enters the bodymaker, it is held against the front surface of the redraw die by a reciprocating, cylindrical redraw sleeve. The nose of the ram then passes through the redraw sleeve and forces the container blank through the redraw die and then through the other dies, after which the redraw sleeve and ram retract and the container body is removed.

Typically, both the ram and the redraw sleeve are mechanically driven off of a rotating wheel through a series of crankshafts, arms and linkages. To provide the necessary timed, linear motion to the redraw sleeve, and to adequately hold the redraw sleeve against the redraw die during drawing and ironing operations, an eccentric, mechanical cam assembly is interconnected to the bodymaker drive wheel with an actuating rod coupled between the cam assembly and redraw sleeve. To retract the redraw sleeve a mechanism such as a hydraulic spring or air cylinder is employed. A counterbalance mechanism is also generally used to provide substantially uniform force by the redraw sleeve against the container blank to ensure appropriate metal flow of the container blank between the redraw sleeve and the redraw die.

As noted above, a typical bodymaker employs a single mechanical assembly to provide both the reciprocal motion to the redraw sleeve and the holding force. Such an assembly is extremely bulky and requires substantial force to set it into motion at the appropriate times and to bring it to a halt. For example, the force required to move the redraw sleeve approximately two and one-half inches from the retracted position into the extended position is substantial (i.e., substantially greater than 600 pounds), and the force utilized to hold the redraw sleeve in place against the container blank is normally about 1,500 pounds. More significantly, the components of mechanical assemblies are prone to rapid wear and frequent breakdown, necessitating down time for maintenance and repair. In fact, at the present time, parts and labor alone for a single bodymaker may cost over $15,000 per year. Lost production capacity when machines are down adds further significant cost.

SUMMARY OF THE INVENTION

In accordance with the present invention, an apparatus is provided which efficiently permits much of the bulky mechanism of the redraw actuator to be eliminated and replaced with more reliable electromagnetic devices. More specifically, the redraw actuator of the present invention includes a linear motor interconnected to a redraw sleeve with one or more actuating rods for extending and retracting the redraw sleeve, and an electromagnet assembly for holding the extended redraw sleeve against the container blank during drawing and ironing. The electromagnet assembly is disposed proximate to the redraw sleeve, with an electromagnet being stationary and an opposing ferromagnetic plate being coupled between the actuating rods and redraw sleeve for reciprocal movement therewith and successive magnetic interface with the electromagnet. The linear motor is displaced axially from the electromagnet assembly through use of the actuating rods, thereby permitting advantageous placement between two bulkheads which support and house roller means for guiding the reciprocating ram along a substantially linear path through the bodymaker.

By virtue of such arrangement, access to the nose of the ram, the redraw sleeve, the electromagnet assembly and other components between the first bulkhead and the redraw die is convenient for inspection, maintenance and repair. Use of electromagnetic components reduces down time, maintenance, repair costs and lost production. Moreover, the apparatus of the present invention uses only that amount of mechanical force necessary to separately move the redraw sleeve between retracted and extended positions, and only that amount of electromagnetic energy necessary and to adequately hold the redraw sleeve against the container blank. Further, the use of electromagnetic components is believed to provide a smoother, more controllable motion profile for the redraw sleeve with reduced risk of damage to the container blank when the redraw sleeve extends.

DETAILED DESCRIPTION

Figure 1:
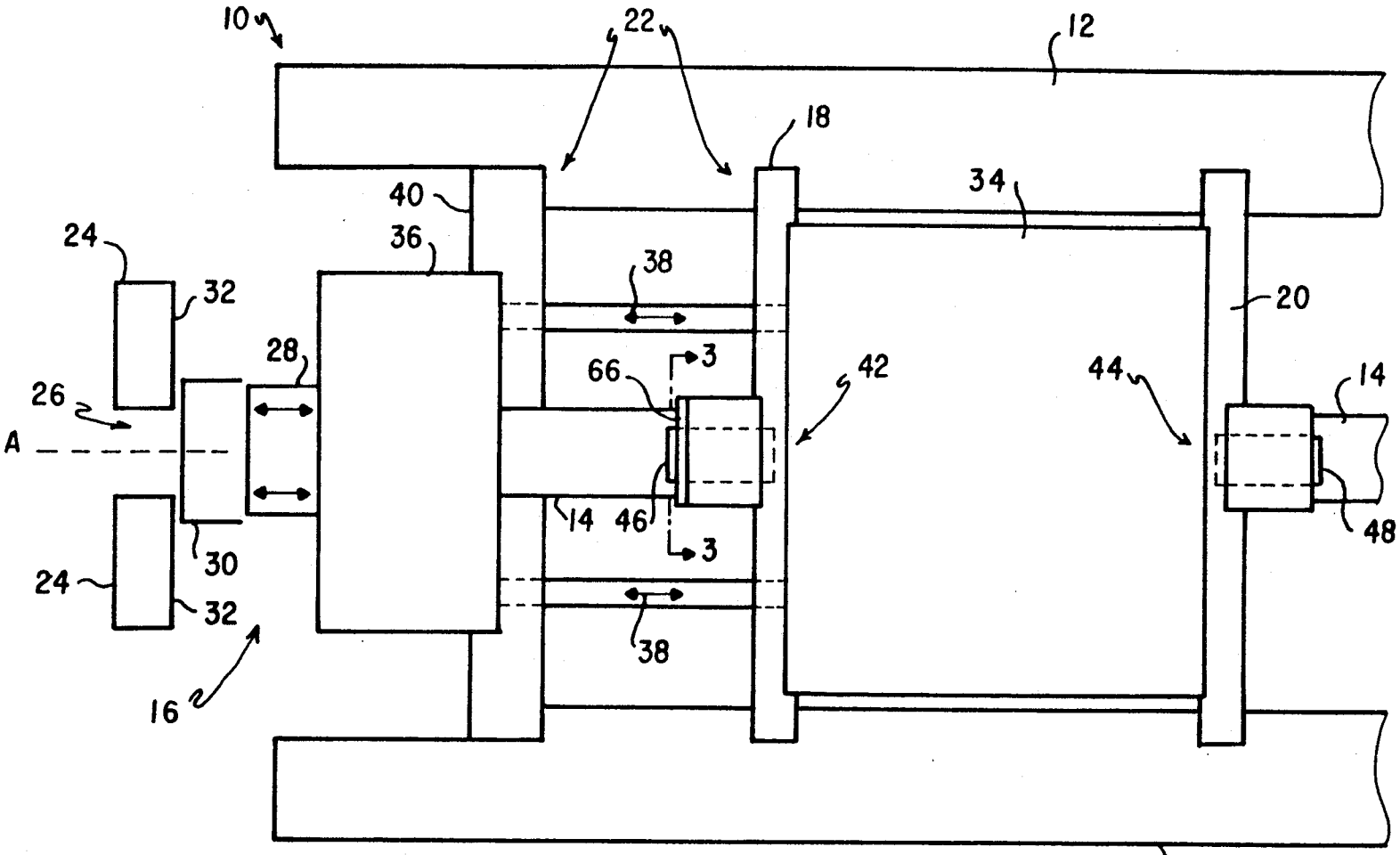
FIG. 1 is a schematic top view of a portion of the bodymaker of the present invention with a redraw sleeve in a retracted position.
Figure 2:
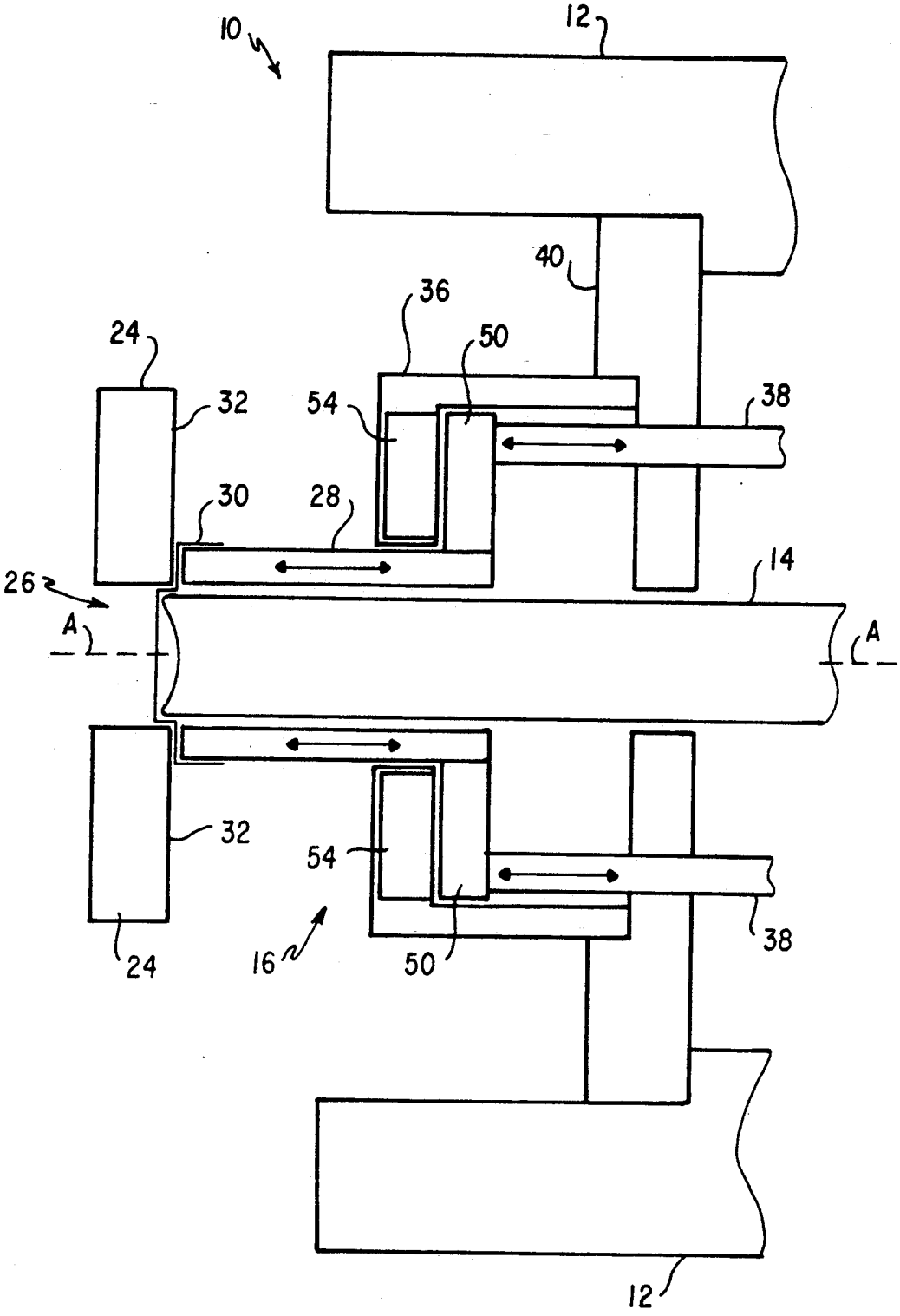
FIG. 2 is a schematic cross-sectional view of a redraw holding assembly and an electromagnet assembly according to the present invention with the redraw sleeve in an extended position.

FIGS. 1 and 2 illustrate schematic top and side views, respectively, of portions of a bodymaker 10 comprising the present invention. The bodymaker 10 includes a support frame 12, forward and rear bulkheads 18 and 20 secured to the frame 12 and supporting ram guidance means 42 and 44, an elongated, reciprocating ram 14 having a longitudinal center axis A—A and supportably disposed through ram guidance means 42 and 44, a redraw holding assembly 16, and an electromagnetic redraw actuator assembly 22.

The redraw holding assembly 16 includes a redraw die 24 and reciprocating redraw sleeve 28. Redraw die 24 comprises a die aperture 26 having a longitudinal center axis collinear with the center axis A—A for receiving ram 14. Redraw sleeve 28 is disposed so that, in its extended position, it will hold a container blank 30 against a front face 32 of the redraw die 24 about the die aperture 26.

The redraw actuator assembly 22 includes a linear motor 34 disposed between the forward and rear bulkheads 18 and 20, an electromagnet assembly 36 disposed between the redraw die 24 and the forward bulkhead 18, and linearly reciprocating actuating rods 38 interconnecting the linear motor 34 with the redraw sleeve 28 (see FIG. 2). An additional bulkhead 40 secures the electromagnet assembly 36 to the support frame 12.

As noted, ram guidance means 42 and 44 are provided to guide the ram 14 along a substantially linear path coincident with the axis A—A. The ram guidance means 42 and 44 may each include a set of three roller bearings 46 and 48, respectively, associated with each of the bulkheads 18 and 20 and uniformly spaced around the ram 14, as further disclosed in U.S. Pat. No. 4,614,104. Only the top one of roller bearings 46 and 48 of the forward and rear ram guidance means 42 and 44 are illustrated in FIG. 1; the remaining two roller bearings of each set being disposed approximately 120° round either side of the top rollers to guide and support the bottom and sides of the ram 14.

In operation, and as shown in FIG. 1, the ram 14 and the redraw sleeve 28 begin in their retracted positions and the container blank 30 is positioned between the redraw die 24 and redraw sleeve 28. A controller (not shown) then activates the linear motor 34 to move the actuating rods 38 and the interconnected redraw sleeve 28 toward the redraw die 24. As shown in FIG. 2, the actuating rods 38 move the redraw sleeve 28 into an extended position, wherein container blank 30 is adjacent to the face 32 of the redraw die 24. Because of the relatively small amount of mass which the linear motor 34 must move, the linear motor 34 is only required to provide between about 300 and about 600 pounds of force. The actuating rods 38 are interconnected to the redraw sleeve 28 with a ferromagnetic plate 50 that comprises electromagnet assembly 36.

When the redraw sleeve 28 is in the extended position, the controller deactivates the linear motor 34 and activates an electromagnet 54, also included in electromagnetic assembly 36, creating an intense magnetic field to attract the ferromagnetic plate 50 toward electromagnet 54. Consequently, the ferromagnetic plate 50 is held against the electromagnet 54 with sufficient force to in turn hold the container blank 30 firmly between the redraw die 24 and the redraw sleeve 28. The ram 14 then advances to force the container blank 30 through the aperture 26 of the redraw die 24 and further dies (not shown) to reduce the diameter and increase the sidewall length of the container blank 30. For improved flow of the container blank 30, the electromagnet 54 can readily hold the ferromagnetic plate 50 with a force of 2,500 pounds.

After the container blank 30 has been forced through the aperture 26 by the ram 14 as desired, the controller deactivates the electromagnet 54 and activates the linear motor 34 to withdraw the redraw sleeve 28 into its retracted position. After the ram 14 has pressed the newly formed container against a bottom domer (not shown), the ram 14 reverses direction and is positioned to enable the bodymaker 10 to receive another container blank.

Figure 3:
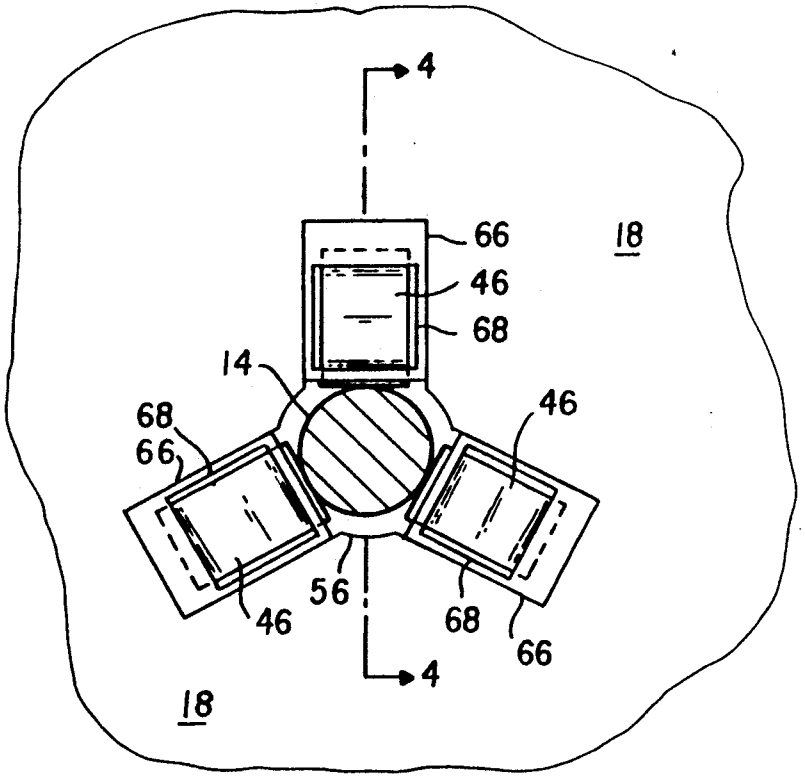
FIG. 3 is an illustrative, partial cross-sectional view taken along line 3—3 of FIG. 1.

To accommodate positioning of the linear motor assembly 34 between the bulkheads 18 and 20, and to increase the amount of space between the forward bulkhead 18 and the additional bulkhead 40, thereby providing access for inspection, maintenance and repair, the roller bearings 46 and 48 of the ram guidance means 42 and 44 are preferably at least partially embedded within the bulkheads 18 and 20. FIG. 3 is a cross-sectional view taken along line 3—3 of FIG. 1. The bulkhead 18 includes an aperture 56 through which the ram 14 passes. The roller bearings 46 are seated within notches communicating with aperture 56.

Figure 4:
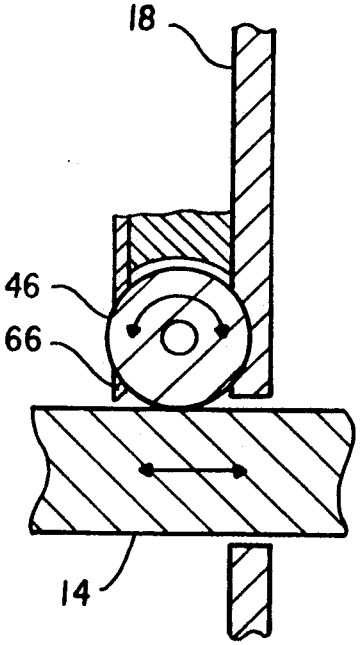
FIG. 4 is an illustrative, partial cross-sectional view taken along line 4—4 of FIG. 3.

Frequently, during the operation of a bodymaker, debris, such as small metal particles, will adhere to the surface of the ram 14 and can damage or otherwise shorten the life of the roller bearings. Consequently, roller protection should be provided. The present invention provides roller protectors 66 in the form of a rigid metal plate corresponding with each roller bearing 46 supported by the forward bulkhead 18. Each of the roller protectors 66 comprise an aperture 68 through which a portion of the associated roller bearing 46 protrudes. As shown in FIG. 4, the edge of the protector 66 is disposed with a very small gap between it and the ram 14, a gap of approximately 2 mils being satisfactory for removal of debris from the surface of the ram 14. By virtue of the shape of the protectors 66 and utilization of apertures 68 for the corresponding roller bearings 46, the protectors 66 can be positioned relatively close to the axis of the roller bearings 46, thereby providing additional access space between the forward bulkhead 18 and the electromagnet assembly 36.

Although the present invention has been described in detail, it should be understood that various changes, substitutions and alterations can be made herein without departing from the spirit and scope of the invention, as defined by the appended claims.

What is claimed is:

1. An apparatus for drawing and ironing a metal container, comprising:

a) a support frame;

b) a redraw assembly mounted to said frame, comprising:

i) a redraw die having an aperture therethrough, said aperture having a longitudinal center axis, through which an elongated ram forces a container blank to reduce the diameter and thickness of the container blank; and ii) a redraw sleeve for supporting the container blank against a face of said redraw die when the container blank is forced through said aperture;

c) a first bulkhead axially spaced from said redraw die and a second bulkhead axially spaced from said first bulkhead, said first and second bulkheads for securing a ram guidance means to said support frame; and d) an electromagnetic redraw actuator, a portion thereof mounted to said frame, having an aperture with a longitudinal center axis substantially collinear with said longitudinal center axis of said redraw die, said longitudinal center axes of said redraw assembly and said electromagnetic redraw actuator defining a substantially linear path for said ram, said electromagnetic redraw actuator comprising:

i) at least one actuating rod extending through said second bulkhead, having a predetermined length and a first end connected to said redraw sleeve;

ii) a linear motor, disposed between said first and second bulkheads and connected to a second end of said at least one actuating rod, for providing reciprocal linear motion parallel to said path to said at least one actuating rod and said redraw sleeve, whereby said redraw sleeve reciprocates between a retracted position and an extended position, said predetermined length of said at least one actuating rod being selected wherein, when said redraw sleeve is in said retracted position, a maintenance cavity is defined between said redraw sleeve and said redraw die and is accessible from a direction substantially transverse to said path; and iii) an electromagnet assembly, disposed between said first bulkhead and said redraw die, comprising an electromagnet mounted to said support frame and an electromagnet target secured to said redraw sleeve, whereby said electromagnet target is magnetically held proximate to said electromagnet when said electromagnet is activated and said redraw sleeve is in said extended position.

2. An apparatus as claimed in claim 1, further including:

a) ram drive means, mounted to said frame, for reciprocally driving said ram along said path; and b) control means for synchronizing activation of said electromagnet and the reciprocating motion of said linear motor with the reciprocating motion of said ram.

3. An assembly as claimed in claim 1, wherein:

a) said ram guidance means comprises a first plurality of roller bearings, mounted on said first bulkhead substantially uniformly around said ram, and a second plurality of roller bearings, mounted on said second bulkhead substantially uniformly around said ram; and b) said roller bearings of at least one of said first and second pluralities of roller bearings are partially embedded within in a corresponding one of said first and second bulkheads.

4. An assembly as claimed in claim 3, wherein said first bulkhead comprises roller protector means associated with each of said roller bearings of said first plurality for removing debris from the surface of said ram.

5. An assembly as claimed in claim 3, wherein:

a) said first plurality of roller bearings are partially embedded within said first bulkhead; and b) said second plurality of roller bearings are partially embedded within said second bulkhead.

6. An assembly as claimed in claim 5, wherein said roller protector means comprises a rigid plate disposed with said associated roller between said bulkhead and said plate, said plate having an edge disposed proximate to said ram surface.

* * * * *